US011024250B2

(12) United States Patent
Kim et al.

(10) Patent No.: US 11,024,250 B2
(45) Date of Patent: Jun. 1, 2021

(54) LIQUID CRYSTAL DISPLAY PANEL AND ELECTRONIC DEVICE HAVING THE SAME

(71) Applicant: SAMSUNG DISPLAY CO, LTD., Yongin-si (KR)

(72) Inventors: Hyoung-Wook Kim, Hwaseong-si (KR); Yeon-Sung Kim, Suwon-si (KR); Choongseob Oh, Yongin-si (KR); Okyi Lee, Seoul (KR); Hyun-Seok Jeong, Suwon-si (KR); Jin Ho Cho, Cheonan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/289,815

(22) Filed: Mar. 1, 2019

(65) Prior Publication Data

US 2019/0272799 A1 Sep. 5, 2019

(30) Foreign Application Priority Data

Mar. 2, 2018 (KR) ..... 10-2018-0025053

(51) Int. Cl.
*G09G 3/36* (2006.01)
*G09G 3/3233* (2016.01)

(52) U.S. Cl.
CPC ..... *G09G 3/3696* (2013.01); *G09G 3/3233* (2013.01); *G09G 3/3607* (2013.01); *G09G 3/3651* (2013.01); *G09G 3/3659* (2013.01); *G09G 3/3677* (2013.01); *G09G 3/3688* (2013.01); *G09G 2300/0452* (2013.01);
(Continued)

(58) Field of Classification Search
CPC .. G09G 3/3648; G09G 3/3677; G09G 3/3659; G09G 3/3233; G09G 3/3607; G09G 3/3266; G09G 3/3696; G09G 3/2074; G09G 3/3651; G09G 2300/0452; G09G 2310/08; G09G 2320/0295; G02F 1/134345;
(Continued)

(56) References Cited

U.S. PATENT DOCUMENTS 7,956,531 B2 * 6/2011 Smith ..... H01L 27/3244 313/505
8,120,598 B2 * 2/2012 Shin ..... G09G 3/3677 345/204
(Continued)

FOREIGN PATENT DOCUMENTS

KR 10-2017-0102134 9/2017

*Primary Examiner* — Dismery Mercedes
(74) *Attorney, Agent, or Firm* — F. Chau & Associates, LLC

(57) ABSTRACT

A liquid crystal display device includes a liquid crystal display panel including a plurality of pixels, a voltage generator generating a gate on voltage and a gate off voltage, a gate driver generating a gate signal provided to the pixel using the gate on voltage and the gate off voltage, and providing the gate signal to the pixels, a data driver providing a data signal to the pixels, and a timing controller generating control signals that control the gate driver and the data driver. Each of the pixels includes a red sub-pixel, a green sub-pixel, and a blue sub-pixel. A voltage level of the gate off voltage provided to the red sub-pixel, a voltage level of the gate off voltage provided to the green sub-pixel, and a voltage level of the gate off voltage provided to the blue sub-pixel are different from one another.

15 Claims, 14 Drawing Sheets

(52) U.S. Cl.
CPC ..... *G09G 2300/0809* (2013.01); *G09G 2310/0243* (2013.01); *G09G 2310/08* (2013.01); *G09G 2320/043* (2013.01)

(58) Field of Classification Search
CPC ..... G02F 1/13624; G02F 1/136286; G02F 1/13306; G06F 3/04166
See application file for complete search history.

(56) References Cited

U.S. PATENT DOCUMENTS 8,916,879 B2 * 12/2014 Huang ..... H01L 27/124 257/59
9,087,475 B2 * 7/2015 Lu ..... G09G 3/006
10,269,277 B2 * 4/2019 Shim ..... G09G 3/3258
2007/0216610 A1 * 9/2007 Smith ..... H05B 45/60 345/76
2008/0150859 A1 * 6/2008 Song ..... G09G 3/3648 345/87
2008/0150868 A1 * 6/2008 Chen ..... G09G 3/364 345/95
2010/0245311 A1 * 9/2010 Lewis ..... G09G 3/3466 345/208
2013/0088679 A1 * 4/2013 Lu ..... G09G 3/006 349/139
2014/0022225 A1 * 1/2014 Lee ..... G09G 3/3648 345/211
2014/0168281 A1 * 6/2014 Ahn ..... H04N 13/341 345/690
2014/0218347 A1 * 8/2014 Lee ..... G09G 3/3614 345/211
2014/0313181 A1 * 10/2014 Hong ..... G09G 3/2003 345/212
2015/0187290 A1 * 7/2015 No ..... G09G 3/20 345/694
2016/0117987 A1 * 4/2016 Byun ..... G09G 3/3266 345/205
2018/0061296 A1 * 3/2018 Shim ..... G09G 3/3258
2019/0005907 A1 * 1/2019 Koo ..... G09G 3/3677
2019/0164498 A1 * 5/2019 Jang ..... G09G 3/3266

* cited by examiner

LIQUID CRYSTAL DISPLAY PANEL AND ELECTRONIC DEVICE HAVING THE SAME

CROSS-REFERENCE TO RELATED APPLICATION

This application claims priority under 35 U.S.C. § 119 to Korean Patent Application No. 10-2018-0025053, filed on Mar. 2, 2018 in the Korean Intellectual Property Office (KIPO), the disclosure of which is incorporated by reference herein in its entirety.

TECHNICAL FIELD

Exemplary embodiments of the inventive concept relate generally to a liquid crystal display device and an electronic device having the same.

DISCUSSION OF RELATED ART

A liquid crystal display (LCD) device includes a lower substrate, an upper substrate, and a liquid crystal layer between the lower substrate and the upper substrate. The LCD device controls an amount of light transmitted to the lower and upper substrates by controlling an electric field applied to the liquid crystal layer, and displays an image on a liquid crystal display panel.

Each of a plurality of pixels of the LCD device drives liquid crystal included in the liquid crystal layer by charging a difference voltage between a data voltage provided to a pixel electrode and a common voltage provided to a common electrode, through a thin film transistor. The thin film transistor turns on in response to a gate on voltage provided to a gate line, and a data signal is provided to the pixel electrode via a data line. Further, the thin film transistor turns off in response to a gate off voltage provided to the gate line, and the data signal charged in the pixel electrode is maintained.

SUMMARY

According to an exemplary embodiment of the inventive concept, a liquid crystal display device may include a liquid crystal display panel including a plurality of pixels, a voltage generator configured to generate a gate on voltage and a gate off voltage, a gate driver configured to generate a gate signal using the gate on voltage and the gate off voltage, and provide the gate signal to the plurality of pixels, a data driver configured to provide a data signal to the plurality of pixels, and a timing controller configured to generate control signals that control the gate driver and the data driver. Each of the plurality of pixels may include a red sub-pixel, a green sub-pixel, and a blue sub-pixel. A voltage level of the gate off voltage provided to the red sub-pixel, a voltage level of the gate off voltage provided to the green sub-pixel, and a voltage level of the gate off voltage provided to the blue sub-pixel may be different from one another.

In an exemplary embodiment of the inventive concept, the liquid crystal display panel may include a first gate line coupled to the red sub-pixel, a second gate line coupled to the green sub-pixel, and a third gate line coupled to the blue sub-pixel.

In an exemplary embodiment of the inventive concept, the voltage generator may generate a first gate off voltage having a first voltage level, a second gate off voltage having a second voltage level, and a third gate off voltage having a third voltage level.

In an exemplary embodiment of the inventive concept, the gate driver may generate a first gate signal provided to the red sub-pixel through the first gate line using the gate on voltage and the first gate off voltage, a second gate signal provided to the green sub-pixel through the second gate line using the gate on voltage and the second gate off voltage, and a third gate signal provided to the blue sub-pixel through the third gate line using the gate on voltage and the third gate off voltage.

In an exemplary embodiment of the inventive concept, the liquid crystal display panel may include gate lines, gate voltage control lines, and switching lines coupled to the plurality of pixels.

In an exemplary embodiment of the inventive concept, the voltage generator may generate an off control voltage having a voltage level lower than the gate off voltage, and the gate driver may generate an off control signal using the off control voltage and provides the off control signal to the plurality of pixels through the gate voltage control lines.

In an exemplary embodiment of the inventive concept, the red sub-pixel may include a first control transistor coupled between a corresponding one of the gate lines and a corresponding one of the gate voltage control lines, the green sub-pixel may include a second control transistor coupled between the corresponding one of the gate lines and the corresponding one of the gate voltage control lines, and the blue sub-pixel may include a third control transistor coupled between the corresponding one of the gate lines and the corresponding one of the gate voltage control lines.

In an exemplary embodiment of the inventive concept, each of ratios of channel length to channel width (W/L) of the first control transistor, the second control transistor, and the third control transistor may be different from one another.

In an exemplary embodiment of the inventive concept, a corresponding one of the switching lines may be coupled to a gate electrode of the first control transistor, a gate electrode of the second control transistor, and a gate electrode of the third control transistor and provide a switching signal to the gate electrode of the first control transistor, the gate electrode of the second control transistor, and the gate electrode of the third control transistor.

In an exemplary embodiment of the inventive concept, the switching signal may be a square wave signal that turns on the first control transistor, the second control transistor, and the third control transistor when the gate signal having the gate off voltage is provided through the corresponding one of the gate lines.

In an exemplary embodiment of the inventive concept, the liquid crystal display panel may include gate lines and gate voltage control lines coupled to the plurality of pixels.

In an exemplary embodiment of the inventive concept, the voltage generator may generate a first off control voltage having a voltage level higher than a voltage level of the gate on voltage and a second off control voltage having a voltage level lower than a voltage level of the gate off voltage, and the gate driver may generate an off control signal using the first off control voltage and the second off control voltage and provide the off control signal to the plurality of pixels through the gate voltage control lines.

In an exemplary embodiment of the inventive concept, the red sub-pixel may include a first diode coupled between a corresponding one of the gate lines and a corresponding one of the gate voltage control lines, and the first diode may drop a voltage level of the gate off voltage. The green sub-pixel may include a second diode coupled between the corresponding one of the gate lines and the corresponding one of the gate voltage control lines, and the second diode may drop a voltage level of the gate off voltage. The blue sub-pixel may include a third diode coupled between the corresponding one of the gate lines and the corresponding one of the gate voltage control lines, and the third diode may drop a voltage level of the gate off voltage.

In an exemplary embodiment of the inventive concept, each of a voltage drop amount of the first diode, a voltage drop amount of the second diode, and a voltage drop amount of the third diode may be different from one another.

According to an exemplary embodiment of the inventive concept, an electronic device may include a display device and a processor that controls the display device. The display device may include a liquid crystal display panel including a plurality of pixels, a voltage generator configured to generate a gate on voltage and a gate off voltage, a gate driver configured to generate a gate signal provided to the pixel using the gate on voltage and the gate off voltage and provide the gate signal to the plurality of pixels, a data driver configured to provide a data signal to the plurality of pixels, and a timing controller configured to generate control signals that control the gate driver and the data driver. Each of the plurality of pixels may include a red sub-pixel, a green sub-pixel, and a blue sub-pixel, and a voltage level of the gate off voltage provided to the red sub-pixel, a voltage level of the gate off voltage provided to the green sub-pixel, and a voltage level of the gate off voltage provided to the blue sub-pixel are different from one another.

In an exemplary embodiment of the inventive concept, the liquid crystal display panel may include a first gate line coupled to the red sub-pixel, a second gate line coupled to the green sub-pixel, and a third gate line coupled to the blue sub-pixel. The voltage generator may generate a first gate off voltage having a first voltage level, a second gate off voltage having a second voltage level, and a third gate off voltage having a third voltage level. The gate driver may generate a first gate signal provided to the red sub-pixel through the first gate line using the gate on voltage and the first gate off voltage, a second gate signal provided to the green sub-pixel through the second gate line using the gate on voltage and the second gate off voltage, and a third gate signal provided to the blue sub-pixel through the third gate line using the gate on voltage and the third gate off voltage.

In an exemplary embodiment of the inventive concept, the liquid crystal display panel may include gate lines and gate voltage control lines coupled to the plurality of pixels.

In an exemplary embodiment of the inventive concept, the red sub-pixel may include a first control transistor coupled between a corresponding one of the gate lines and a corresponding one of the gate voltage control lines, the green sub-pixel may include a second control transistor coupled between the corresponding one of the gate lines and the corresponding one the gate voltage control lines, and the blue sub-pixel may include a third control transistor coupled between the corresponding one of the gate lines and the corresponding one of the gate voltage control lines. Each of ratios of channel length to channel width (W/L) of the first control transistor, the second control transistor, and the third control transistor may be different from one another, and an off control signal provided through the gate voltage control line may be a static voltage having a voltage level lower than the gate off voltage.

In an exemplary embodiment of the inventive concept, the liquid crystal display panel may further include a plurality of switching lines coupled to the plurality of pixels. A corresponding one of the switching lines may be coupled to a gate electrode of the first control transistor, a gate electrode of the second control transistor, and a gate electrode of the third control transistor, and a switching signal may be provided through the plurality of switching lines.

In an exemplary embodiment of the inventive concept, the red sub-pixel may include a first diode coupled between a corresponding one of the gate lines and a corresponding one of the gate voltage control lines, and the first diode may drop a voltage level of the gate off voltage. The green sub-pixel may include a second diode coupled between the corresponding one of the gate lines and the corresponding one of the gate voltage control lines, and the second diode may drop a voltage level of the gate off voltage. The blue sub-pixel may include a third diode coupled between the corresponding one of the gate lines and the corresponding one of the gate voltage control lines, and the third diode may drop a voltage level of the gate off voltage. Each of an amount of voltage drop of the first diode, an amount of voltage drop of the second diode, and an amount of voltage drop of the third diode may be different from one another, and the gate off signal provided through the gate line may be a square signal that has a voltage level higher than a voltage level of the gate on voltage and lower than the voltage level of the gate off voltage.

According to an exemplary embodiment of the inventive concept, a liquid crystal display device may include a liquid crystal display panel including a plurality of pixels, a voltage generator configured to generate a gate on voltage and first through third gate off voltages, where the first through third gate off voltages are different from one another, and a gate driver configured to generate first through third gate signals using the first through third gate off voltages, respectively, and the gate on voltage, and to provide the first through third gate signals to the plurality of pixels. A first pixel among the plurality of pixels may include a red sub-pixel, a green sub-pixel, and a blue sub-pixel. The red sub-pixel may be connected to a first gate line among a plurality of gate lines to receive the first gate signal. The green sub-pixel may be connected to a second gate line among the plurality of gate lines to receive the second gate signal. The blue sub-pixel may be connected to a third gate line among the plurality of gate lines to receive the third gate signal.

BRIEF DESCRIPTION OF THE DRAWINGS

The above and other features of the inventive concept will be more clearly understood by describing in detail exemplary embodiments thereof with reference to the accompanying drawings.

DETAILED DESCRIPTION OF THE EMBODIMENTS

Figure 1:
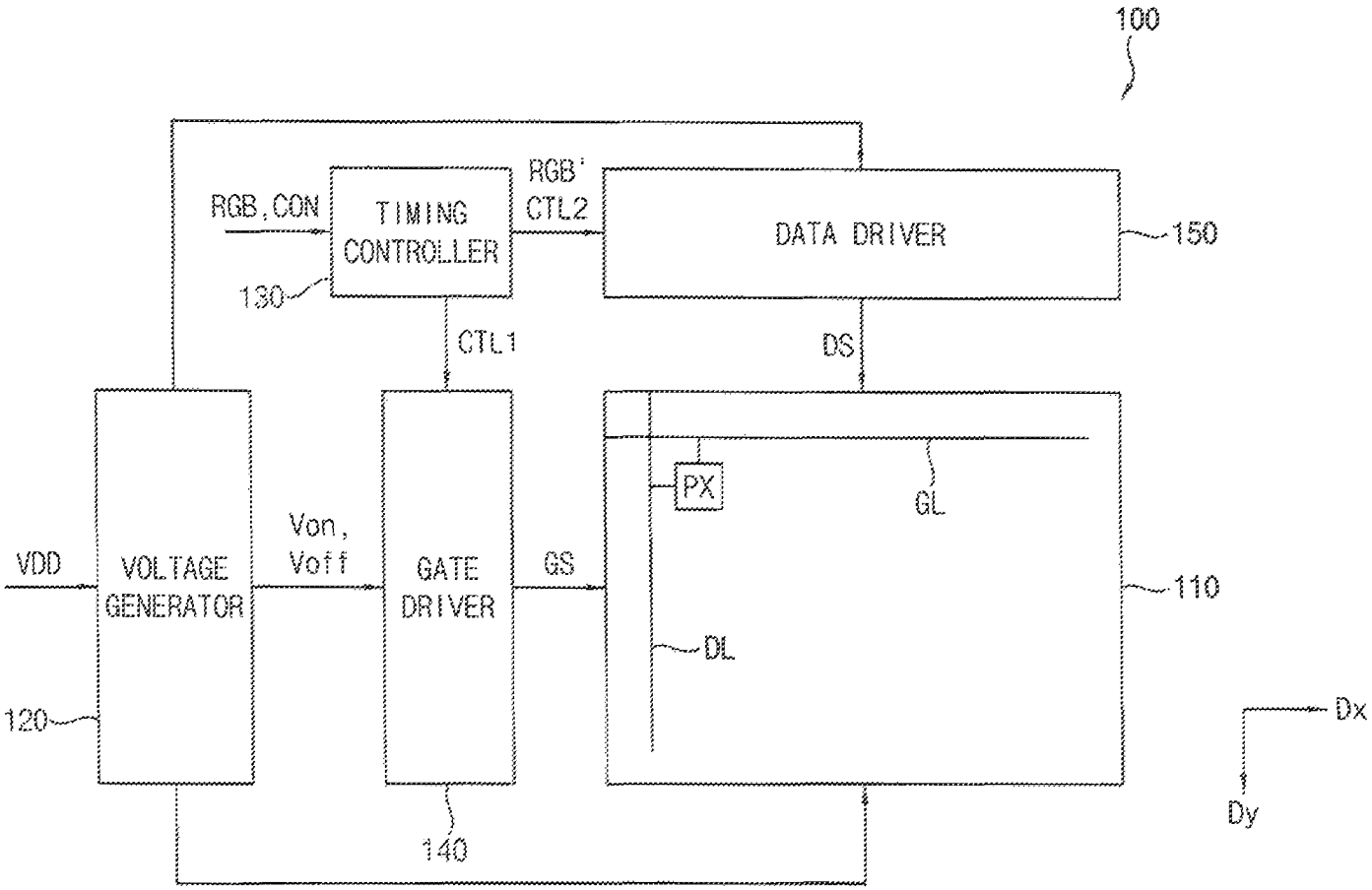
FIG. 1 is a block diagram illustrating a liquid crystal display device according to an exemplary embodiment of the inventive concept.

Exemplary embodiments of the inventive concept provide a liquid crystal display device capable of improving display quality.

Exemplary embodiments of the inventive concept also provide an electronic device including the liquid crystal device capable of improving display quality.

Hereinafter, exemplary embodiments of the inventive concept will be explained in detail with reference to the accompanying drawings. Like reference numerals may refer to like elements throughout this application.

Figure 2:
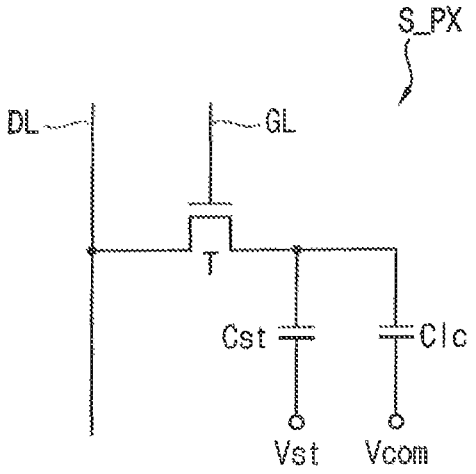
FIG. 2 is a circuit diagram illustrating a pixel of a liquid crystal display panel included in the liquid crystal display device of FIG. 1 according to an exemplary embodiment of the inventive concept.
Figure 3:
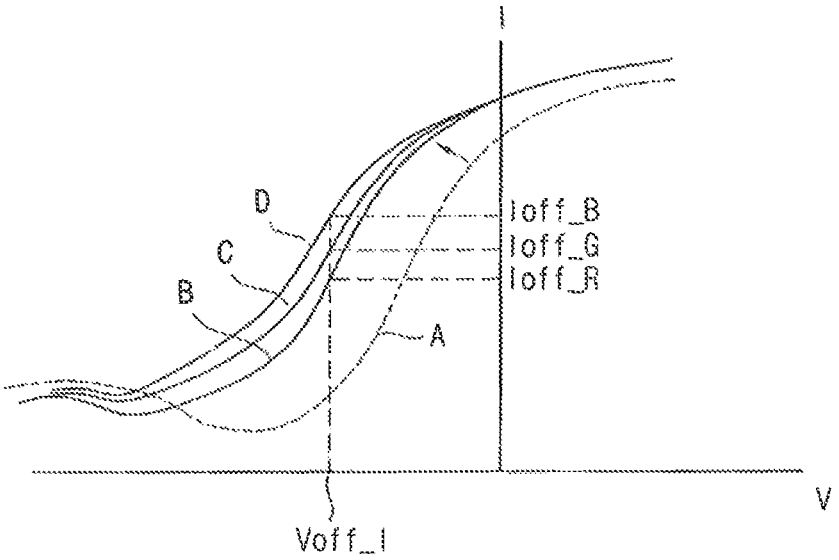
FIG. 3 is a graph illustrating an operation property of a transistor included in the pixel of FIG. 2 according to an exemplary embodiment of the inventive concept.

FIG. 1 is a block diagram illustrating a liquid crystal display device according to an exemplary embodiment of the inventive concept. FIG. 2 is a circuit diagram illustrating a pixel of a liquid crystal display panel included in the liquid crystal display device of FIG. 1 according to an exemplary embodiment of the inventive concept. FIG. 3 is a graph illustrating an operation property of a transistor included in the pixel of FIG. 2 according to an exemplary embodiment of the inventive concept.

Referring to FIG. 1, a liquid crystal display device 100 may include a liquid crystal display panel 110, a voltage generator 120, a timing controller 130, a gate driver 140, and a data driver 150.

The liquid crystal display panel 110 may include a plurality of pixels PX. Each of the pixels PX may include a plurality of sub-pixels S_PX. For example, each of the pixels PX may include a red sub-pixel, a green sub-pixel, and a blue sub-pixel. For example, each of the pixels PX may further include a white sub-pixel and a yellow sub-pixel.

Referring to FIG. 2, each of the sub-pixels S_PX may include a thin film transistor T electrically coupled to a gate line GL and a data line DL, a liquid crystal capacitor Clc coupled to the thin film transistor T, and a storage capacitor Cst coupled to the thin film transistor T. The thin film transistor T may include a gate terminal coupled to the gate line GL, an input terminal coupled to the data line DL, and an output terminal coupled to a first electrode of the liquid capacitor Clc. The thin film transistor T may include amorphous silicon or poly crystalline silicon. The liquid crystal capacitor Clc may include the first electrode coupled to the thin film transistor T and a second electrode that receives a common voltage Vcom. The first electrode may be a pixel electrode formed in a first substrate of the liquid crystal display panel 110 and the second electrode may be a common electrode formed in a second substrate facing the first substrate. Alternatively, the common electrode may be formed in the first substrate. The storage capacitor Cst may include a third electrode coupled to the first electrode of the liquid crystal capacitor Clc and a fourth electrode coupled to a storage line having a storage voltage Vst. The third electrode may be the pixel electrode and the fourth electrode may be the storage line overlapped with the pixel electrode.

The thin film transistor T may turn on or turn off in response to a gate signal GS provided through the gate line GL. Here, the gate signal GS may include a gate on voltage Von having a voltage level that turns on the thin film transistor T and a gate off voltage Voff having a voltage level that turns off the thin film transistor T. A data signal DS provided through the data line DL may be provided to the liquid crystal capacitor Clc and the storage capacitor Cst when the gate signal GS having the gate on voltage Von is provided. The liquid crystal capacitor Clc may transmit light according to the data signal DS provided when the thin film transistor T turns on. The liquid crystal display device 100 may display an image by storing the data signal DS in the storage capacitor Cst when the thin film transistor T turns on and providing the stored data signal DS to the liquid crystal capacitor Clc when the thin film transistor T turns off.

Referring to FIG. 3, a driving property (e.g., a voltage-current property) of the thin film transistor T may be changed as a usage time passes. Here, the driving property of the thin film transistor T included in the red sub-pixel, the driving property of the thin film transistor T included in the green sub-pixel, and the driving property of the thin film transistor T include in the blue sub-pixel may be differently changed according to a difference in photon energy of light that passes a red color filter, a green color filter, and a blue color filter.

An initial driving property A of the thin film transistor T included in the red sub-pixel, the thin film transistor T included in the green sub-pixel, and the thin film transistor T included in the blue sub-pixel may be substantially the same or similar. However, a driving property B of the thin film transistor T included in the red sub-pixel, a driving property C of the thin film transistor T included in the green sub-pixel, and a driving property D of the thin film transistor T included in the blue sub-pixel may be differently changed as the usage time of the liquid crystal display device 100 passes. When the gate off voltage Voff_I is provided to the thin film transistor T included in the red sub-pixel, the thin film transistor T included in the green sub-pixel, and the thin film transistor T included in the blue sub-pixel, an initial current Ioff_I may flow through each of the thin film transistors T at an initial time. However, when the gate off voltage Voff_I is provided to the thin film transistor T included in the red sub-pixel, the thin film transistor T included in the green sub-pixel, and the thin film transistor T included in the blue sub-pixel, a first current Ioff_R may flow through the thin film transistor T included in the red sub-pixel, a second current Ioff_G may flow through the thin film transistor T included in the green sub-pixel, and a third current Ioff_B may flow through the thin film transistor T included in the blue sub-pixel because the driving properties of the thin film transistor T included in the red sub-pixel, the thin film transistor T included in the green sub-pixel, and the thin film transistor T included in the blue sub-pixel are differently changed as the usage time passes.

As the driving properties of the thin film transistor T included in the red sub-pixel (e.g., driving property B), the thin film transistor T included in the green sub-pixel (e.g., driving property C), and the thin film transistor T included in the blue sub-pixel (e.g., driving property D) are differently changed, amounts of current that leak from the thin film transistor T included in the red sub-pixel, the thin film transistor T included in the green sub-pixel, and the thin film transistor T included in the blue sub-pixel may be different from one another. To overcome these problems, the liquid crystal display device 100 of FIG. 1 may provide the gate off voltage Voff having different voltage levels to the thin film transistor T included in the red sub-pixel, the thin film transistor T included in the green sub-pixel, and the thin film transistor T included in the blue sub-pixel according to the driving properties of the thin film transistor T included in the red sub-pixel, the thin film transistor T included in the green sub-pixel, and the thin film transistor T included in the blue sub-pixel. Thus, the current leaked from the thin film transistor T included in the red sub-pixel, the thin film transistor T included in the green sub-pixel, and the thin film transistor T included in the blue sub-pixel may be minimized. Hereinafter, the liquid crystal display device 100 will be described in detail.

The liquid crystal display panel 110 may include the gate lines GL and the data lines DL. The data lines DL may extend in a second direction Dy and be arranged in a first direction Dx perpendicular to the second direction Dy. The gate lines GL may extend in the first direction Dx and be arranged in the second direction Dy. The first direction Dx may be substantially parallel with a long side of the liquid crystal display panel 110, and the second direction Dy may be substantially parallel with a short side of the liquid crystal display panel 110. Each of the pixels PX may be formed in an intersection region of one of the data lines DL and one of the gate lines GL.

In exemplary embodiments of the inventive concept, the liquid crystal display panel 110 may include a first gate line coupled to the red sub-pixel, a second gate line coupled to the green sub-pixel, and a third gate line coupled to the blue sub-pixel. A first gate off voltage having a first voltage level may be provided to the red sub-pixel through the first gate line. A second gate off voltage having a second voltage level may be provided to the green sub-pixel through the second gate line. A third gate off voltage having a third voltage level may be provided to the blue sub-pixel through the third gate line. Here, the first voltage level, the second voltage level, and the third voltage level may be different from one another. Thus, the first gate off voltage, the second gate off voltage, and the third gate off voltage having different voltage levels may be provided to the thin film transistor T of the red sub-pixel, the thin film transistor T of the green sub-pixel, and the thin film transistor T of the blue sub-pixel, respectively.

In exemplary embodiments of the inventive concept, the liquid crystal display panel 110 may further include a gate voltage control line and a switching line coupled to the pixels PX. The red sub-pixel may include a first control transistor coupled between the gate line GL and the gate voltage control line. The green sub-pixel may include a second control transistor coupled between the gate line GL and the gate voltage control line. The blue sub-pixel may include a third control transistor coupled between the gate line GL and the gate voltage control line. Here, each of ratios of channel length to channel width (W/L) of the first control transistor, the second control transistor, and the third control transistor may be different from one another. An off control signal may be provided through the gate voltage control line. The off control signal may be a constant or static voltage signal having a voltage level lower than the gate off voltage Voff. The gate electrodes of the first control transistor, the second control transistor, and the third control transistor may be coupled to the switching line. A switching signal may be provided to the first control transistor, the second control transistor, and the third control transistor through the switching line. The switching signal may be a square waveform that turns on the first control transistor, the second control transistor, and the third control transistor when the gate signal GS having the gate off voltage Voff is provided through the gate line GL. The current may flow from the gate line GL to the gate voltage control line when the first control transistor, the second control transistor, and the third control transistor turn on in response to the switching signal. Thus, a voltage level of the gate off voltage Voff provided through the gate line GL may be dropped. Here, drop amounts of the gate off voltage Voff of the red sub-pixel, the green sub-pixel, and the blue sub-pixel may be different because the ratios of channel length to channel width of the first control transistor, the second control transistor, and the third control transistor are different from one another. Thus, the gate off voltage Voff having different voltage levels may be provided to the thin film transistor T of the red sub-pixel, the thin film transistor T of the green sub-pixel, and the thin film transistor T of the blue sub-pixel.

In exemplary embodiments of the inventive concept, the liquid crystal display panel 110 may include the gate voltage control line coupled to the pixels PX. The red sub-pixel may include a first diode coupled between the gate line GL and the gate voltage control line. The green sub-pixel may include a second diode coupled between the gate line GL and the gate voltage control line. The blue sub-pixel may include a third diode coupled between the gate line GL and the gate voltage control line. Here, a voltage drop amount of the first diode, the voltage drop amount of the second diode, and the voltage drop amount of the third diode may be different from one another. The off control signal may be provided from the gate voltage control line. The off control signal may be a square waveform signal that includes a first off control voltage having a voltage higher than the gate on voltage Von and a second off control voltage having a voltage level lower than the gate off voltage Voff. The off control signal having the first off control voltage may be provided when the gate on voltage Von is provided through the gate line GL, and the off control signal having the second off control voltage may be provided when the gate off voltage Voff is provided. The first diode, the second diode, and the third diode may not operate when the gate on voltage Von is provided through the gate line GL because the off control signal having the first off control voltage is provided through the gate voltage control line. The first diode, the second diode, and the third diode may turn on and the current of the gate line GL may flow to the gate voltage control line when the gate off voltage Voff is provided through the gate line GL because the off control signal having the second off control voltage is provided through the gate voltage control line. Thus, the voltage level of the gate off voltage Voff of the gate signal GS provided through the gate line GL may be dropped. Here, the gate off voltage Voff having different voltage levels may be provided to the thin film transistors T included in each of the red sub-pixel, the green sub-pixel, and the blue sub-pixel.

The voltage generator 120 may receive a direct current voltage VDD and generate a plurality of voltages to operate the liquid crystal display device 100. The voltage generator 120 may generate the gate on voltage Von and the gate off voltage Voff. In exemplary embodiments of the inventive concept, the voltage generator 120 may generate the first gate off voltage having a first voltage level, the second gate off voltage having the second voltage level, and the third gate off voltage having the third voltage level. In exemplary embodiments of the inventive concept, the voltage generator 120 may generate the gate off voltage Voff having a predetermined voltage level. The voltage generator 120 may provide the gate on voltage Von and the gate off voltage Voff to the gate driver 140. Further, the voltage generator 120 may generate the off control voltage. In exemplary embodiments of the inventive concept, the voltage generator 120 may generate the off control voltage having the voltage level lower than the gate off voltage Voff of the gate signal GS. Here, the voltage generator 120 may provide the off control signal to the gate driver 140. The voltage generator 120 may directly provide the off control voltage to the gate voltage control line of the liquid crystal display panel 110. In exemplary embodiments of the inventive concept, the voltage generator 120 may generate the first off control voltage having the voltage level higher than the gate on voltage Von and the second off control voltage having the voltage level lower than the gate off voltage Voff. Here, the first off control voltage and the second off control voltage may be provided to the gate driver 140. Further, the voltage generator 120 may generate an analog power voltage, a digital power voltage, a common voltage, etc. The analog power voltage and the digital power voltage may be provided to the data driver 150 or the timing controller 130 as a driving voltage. The common voltage may be provided to the common electrode of the liquid crystal display panel 110. For example, the voltage generator 120 may include a DC-DC converter.

The timing controller 130 may generate a first control signal CTL1 and a second control signal CTL2 that control the gate driver 140 and the data driver 150. The timing controller 130 may convert first image data RGB provided from an external device to second image data RGB'. The timing controller 130 may generate the first control signal CTL1 and the second control signal CTL2 to control a driving timing of the second image data RGB'. For example, the external device may be a graphic processor that processes image information. The timing controller 130 may convert the first image data RGB to the second image data RGB' by applying an algorithm that compensates display quality of the first image data RGB. The timing controller 130 may receive a control signal CON from the external device and generate a vertical start signal and a first clock signal provided to the gate driver 140. Further, the timing controller 130 may generate a horizontal start signal and a second clock signal provided to the data driver 150. The timing controller 130 may provide the vertical start signal and the first clock signal to the gate driver 140 as the first control signal CTL1, and provide the horizontal start signal and the second clock signal to the data driver 150 as the second control signal CTL2.

The gate driver 140 may generate the gate signal GS, and provide the gate signal GS to the pixel PX. The gate driver 140 may generate the gate signal GS based on the gate on voltage Von provided from the voltage generator 120, the gate of voltage Voff provided from the voltage generator 120, and the first control signal CTL1 provided from the timing controller 130. The gate driver 140 may sequentially provide the gate signal GS to the gate lines GL. In exemplary embodiments of the inventive concept, the gate driver 140 may generate the first gate signal provided to the red sub-pixel through the first gate line based on the gate on voltage Von and the first gate off voltage, generate the second gate signal provided to the green sub-pixel through the second gate line based on the gate on voltage Von and the second gate off voltage, and generate the third gate signal provided to the blue sub-pixel through the third gate line based on the gate on voltage Von and the third gate off voltage. In exemplary embodiments of the inventive concept, the gate driver 140 may generate the gate signal GS provided to the red sub-pixel, the green sub-pixel, and the blue sub-pixel through the gate line GL based on the gate on voltage Von and the gate off voltage Voff. Further, the gate driver 140 may generate the off control signal. In exemplary embodiments of the inventive concept, the gate driver 140 may generate the off control signal based on the off control voltage and provide the off control signal to the pixels PX through the gate voltage control line. In exemplary embodiments of the inventive concept, the gate driver 140 may generate the off control signal based on the first off control voltage and the second off control voltage and provide the off control signal to the pixels PX through the gate voltage control line.

The data driver 150 may generate the data signal DS and output the data signal DS to the data lines DL of the liquid crystal display panel 110 based on the second control signal CTL2. The data driver 150 may generate gamma voltages based on gamma reference voltages provided from the voltage generator 120 and generate data signals DS corresponding to the second image data RGB' based on the gamma voltages. The data driver 150 may output the data signal DS to the data lines DL of the liquid crystal display panel 110 in response to the horizontal start signal and the second clock signal (e.g., CTL2) provided form the timing controller 130.

As described above, the liquid crystal display device 100 of FIG. 1 may provide the gate off voltages Voff having different voltage levels to the thin film transistors T included in each of the red sub-pixel, the green sub-pixel, and the blue sub-pixel based on the driving properties of the thin film transistors T included in each of the red sub-pixel, the green sub-pixel, and the blue sub-pixel. Thus, the leakage current of the thin film transistor T included in each of the red sub-pixel, the green sub-pixel, and the blue sub-pixel may be minimized when the gate off voltage Voff is provided. Therefore, display quality of the liquid crystal display device 100 may improve.

Figure 4:
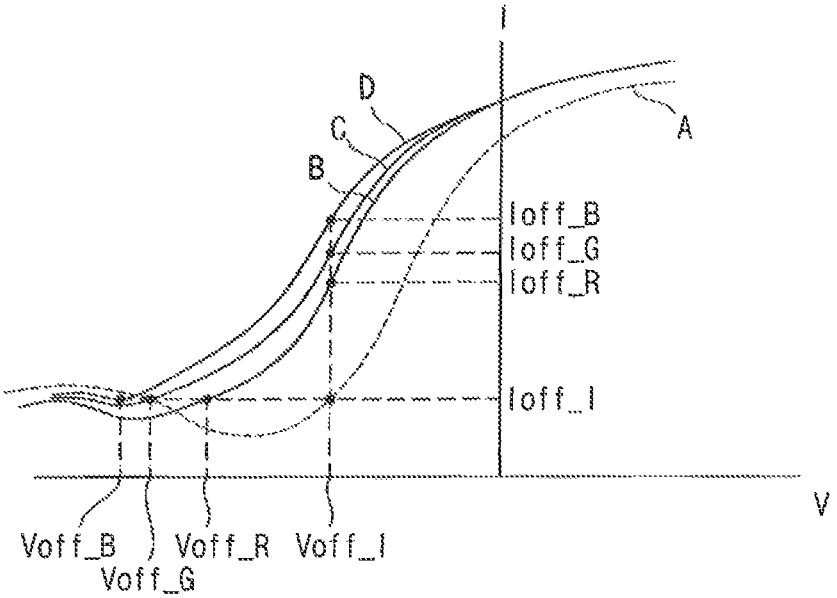
FIG. 4 is a graph illustrating a gate voltage provided to the pixel included in the liquid crystal display device of FIG. 1 according to an exemplary embodiment of the inventive concept.

FIG. 4 is a graph illustrating a gate voltage provided to the pixel included in the liquid crystal display device of FIG. 1 according to an exemplary embodiment of the inventive concept.

Referring to FIG. 4, the driving property of the thin film transistor included in the pixel may be changed as the usage time of the liquid crystal display device increases. The current flowing through the thin film transistor may be changed when the driving property of the thin film transistor is changed so that a color difference between the pixels may occur. The initial driving property A of the thin film transistors included in each of the red sub-pixel, the green sub-pixel, and the blue sub-pixel may be substantially the same or similar. The difference between the driving property B of the thin film transistor included in the red sub-pixel, the driving property C of the thin film transistor included in the green sub-pixel, and the driving property D of the thin film transistor included in the blue sub-pixel may occur because of the difference in photon energy as the usage time of the liquid crystal display device passes. The driving property B of the thin film transistor included in the red sub-pixel, the driving property C of the thin film transistor included in the green sub-pixel, and the driving property D of the thin film transistor included in the blue sub-pixel may be measured after the predetermined usage time passes (e.g., using an aging test). The liquid crystal display device according to an exemplary embodiment of the inventive concept may determine a gate off voltage Voff_R of the red sub-pixel, a gate off voltage Voff_G of the green sub-pixel, and a gate off voltage Voff_B of the blue sub-pixel based on the driving properties (B, C, D).

Referring to FIG. 4, the thin film transistor included in the pixel of the liquid crystal display device may have the initial driving property A in an initial time. The thin film transistor of the red sub-pixel may have the driving property B, the thin film transistor of the green sub-pixel may have the driving property C, and the thin film transistor of the blue sub-pixel may have the driving property C, as the usage time of the liquid crystal display device passes. An initial current Ioff_I may flow through the thin film transistor when the gate off voltage Voff_I is provided in the initial time. The first current Ioff_R flowing through the thin film transistor of the red sub-pixel, the second current Ioff_G flowing through the thin film transistor of the green sub-pixel, and the third current Ioff_B flowing through the thin film transistor of the blue sub-pixel may increase more than the initial current Ioff_I when the gate off voltage Voff_I is provided in the initial time. The voltages that allow the current flowing through the thin film transistor of the red sub-pixel, the thin film transistor of the green sub-pixel, and the thin film transistor of the blue sub-pixel to be the same as the initial current Ioff_I may be determined as the gate off voltage Voff_R for the red sub-pixel, the gate off voltage Voff_G for the green sub-pixel, and the gate off voltage Voff_B for the blue sub-pixel, respectively.

Figure 5A:
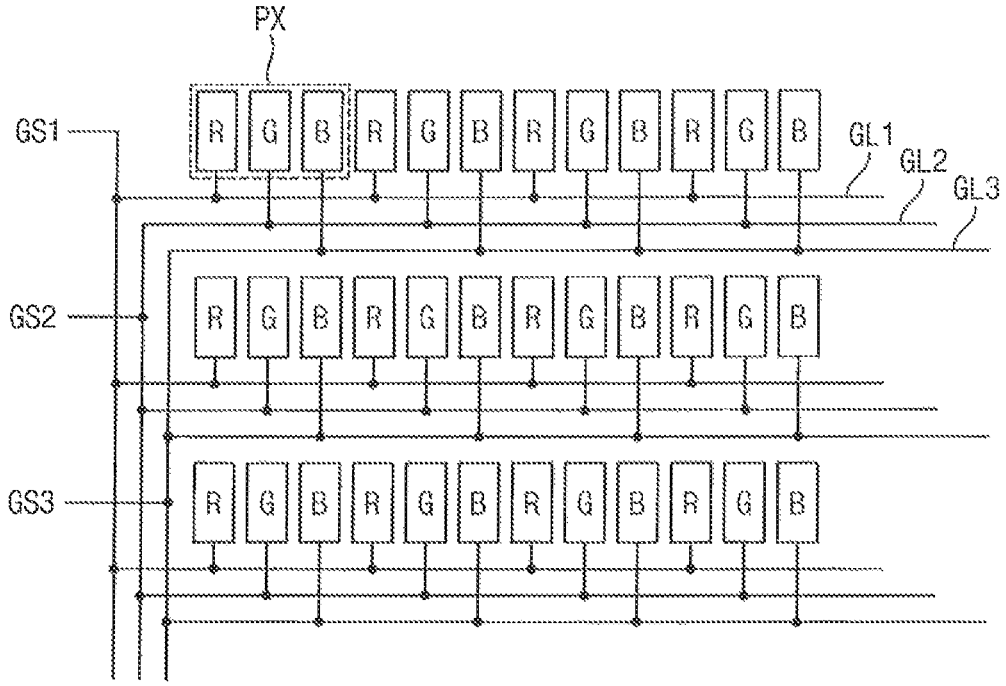
FIG. 5A is a diagram illustrating a liquid crystal display panel included in the liquid crystal display device of FIG. 1 according to an exemplary embodiment of the inventive concept.
Figure 5B:
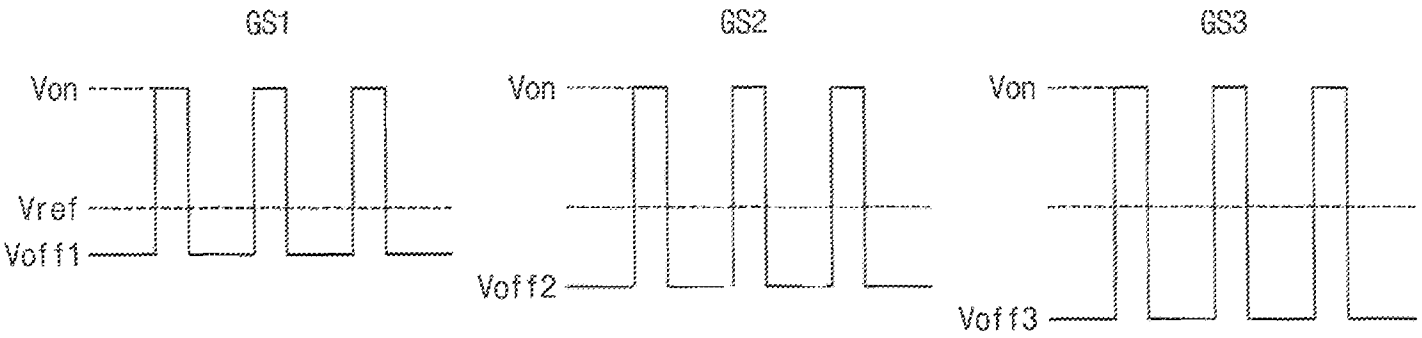
FIG. 5B is a waveform diagram illustrating a gate signal provided to pixels included in the liquid crystal display panel of FIG. 5A according to an exemplary embodiment of the inventive concept.

FIG. 5A is a diagram illustrating a liquid crystal display panel included in the liquid crystal display device of FIG. 1 and FIG. 5B is a waveform diagram illustrating a gate signal provided to pixels included in the liquid crystal display panel of FIG. 5A according to an exemplary embodiment of the inventive concept.

Referring to FIG. 5A, the liquid crystal display panel may include the plurality of pixels PX. Each of the pixels may include the red sub-pixel R, the green sub-pixel G, and the blue sub-pixel B. Each of the red sub-pixel R, the green sub-pixel G, and the blue sub-pixel B may include the thin film transistor T, the liquid crystal capacitor Clc, and the storage capacitor Cst as described in FIG. 2. A first gate line GL1, a second gate line GL2, and a third gate line GL3 may be formed in the liquid crystal display panel. The first gate line GL1 may be coupled to the red sub-pixel R, the second gate line GL2 may be coupled to the green sub-pixel G, and the third gate line GL3 may be coupled to the blue sub-pixel B.

The voltage generator (e.g., the voltage generator 120 of FIG. 1) may generate the gate on voltage Von, the first gate off voltage Voff1 having the first voltage level, the second gate off voltage Voff2 having the second voltage level, and the third gate off voltage Voff3 having the third voltage level. For example, a reference voltage Vref described in FIG. 5B may have a ground level. The voltage level of the gate on voltage Von may be higher than the reference voltage Vref and the voltage levels of the first gate off voltage Voff1, the second gate off voltage Voff2, and the third gate off voltage Voff3 may be lower than the reference voltage Vref. The gate driver may generate a first gate signal GS1 based on the gate on voltage Von and the first gate off voltage Voff1 provided from the voltage generator, generate a second gate signal GS2 based on the gate on voltage Von and the second gate off voltage Voff2 provided from the voltage generator, and generate a third gate signal GS3 based on the gate on voltage Von and the third gate off voltage Voff3. Here, a first voltage level of the first gate off voltage Voff1, a second voltage level of the second gate off voltage Voff2, and a third voltage level of the third gate off voltage Voff3 may be determined based on the driving properties of the thin film transistor of the red sub-pixel R, the thin film transistor of the green sub-pixel G, and the thin film transistor of the blue sub-pixel B.

Referring to FIGS. 5A and 5B, the first gate signal GS1 may be provided to the red sub-pixel R through the first gate line GL1, the second gate signal GS2 may be provided to the green sub-pixel G through the second gate line GL2, and the third gate signal GS3 may be provided to the blue sub-pixel B through the third gate line GL3. Here, the voltage level of the first gate off voltage Voff1 of the first gate signal GS1, the voltage level of the second gate off voltage Voff2 of the second gate signal GS2, and the voltage level of the third gate off voltage Voff3 of the third gate signal GS3 may be different from one another.

The liquid crystal display device according to an exemplary embodiment of the inventive concept may provide the first through third gate off voltages Voff1, Voff2, and Voff3 of which voltage levels are different from one another, so that the current leaked through the thin film transistor may be minimized although the driving properties of the thin film transistor of the red sub-pixel R, the thin film transistor of the green sub-pixel G, and the thin film transistor of the blue sub-pixel B are changed.

Figure 6A:
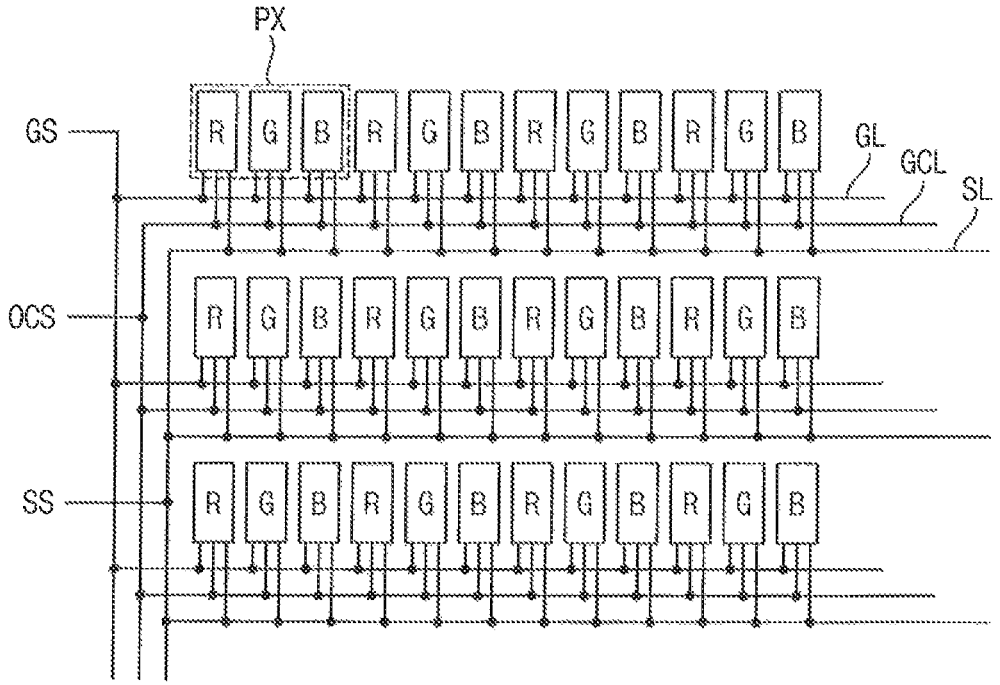
FIG. 6A is a diagram illustrating a liquid crystal display panel included in the liquid crystal display device of FIG. 1 according to an exemplary embodiment of the inventive concept.
Figure 6B:
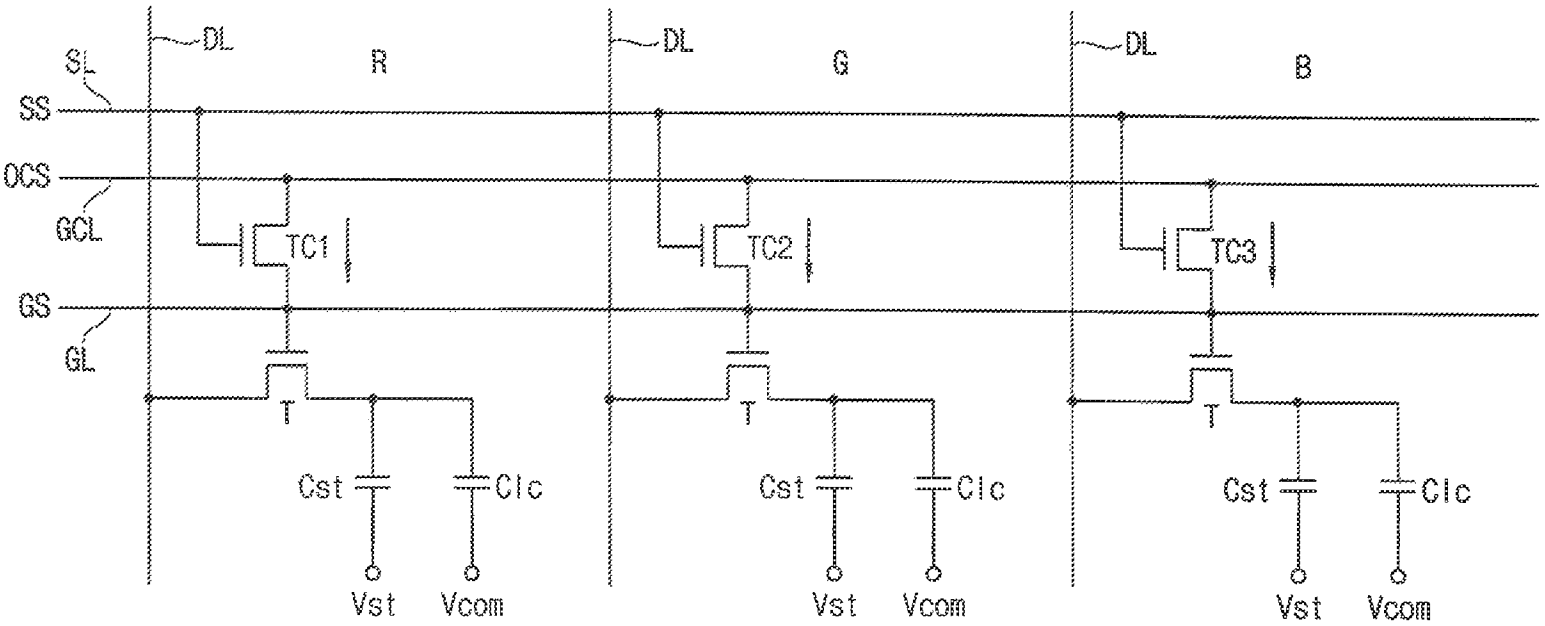
FIG. 6B is a diagram illustrating a pixel included in the liquid crystal display panel of FIG. 6A according to an exemplary embodiment of the inventive concept.
Figure 6C:
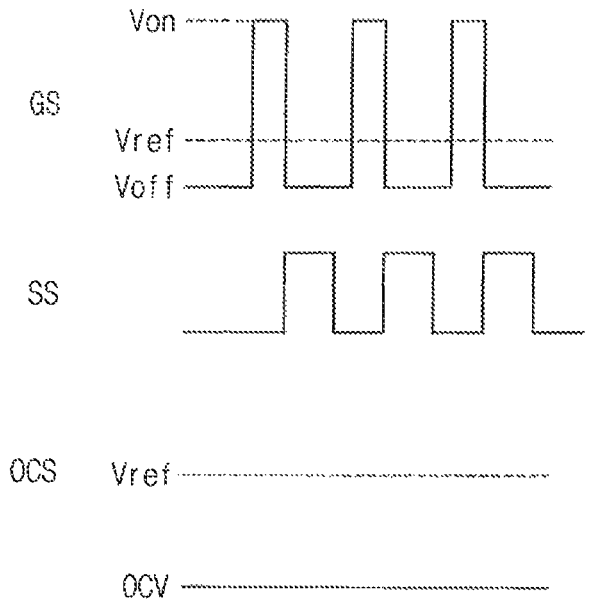
FIGS. 6C and 6D are waveform diagrams illustrating signals provided to the pixel of FIG. 6B according to an exemplary embodiment of the inventive concept.
Figure 6D:
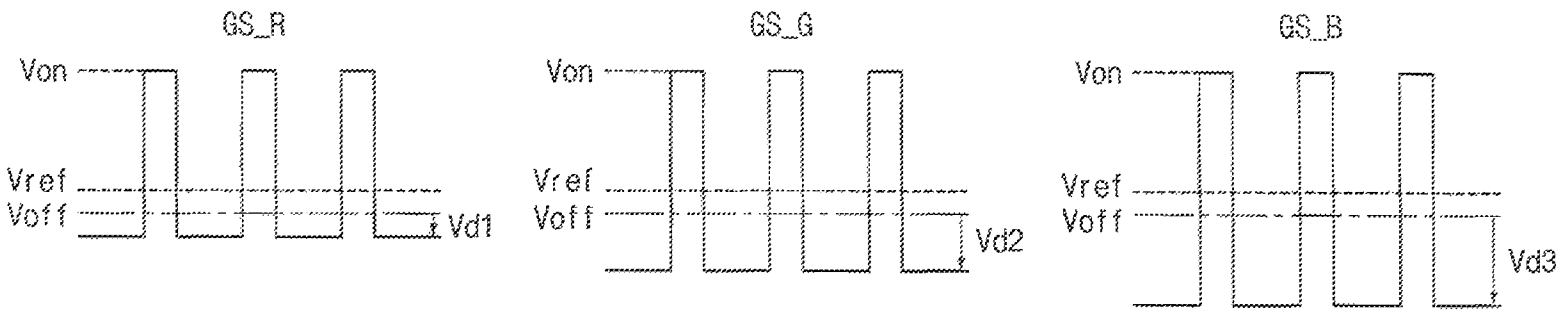

FIG. 6A is a diagram illustrating a liquid crystal display panel included in the liquid crystal display device of FIG. 1 according to an exemplary embodiment of the inventive concept. FIG. 6B is a diagram illustrating a pixel included in the liquid crystal display panel of FIG. 6A according to an exemplary embodiment of the inventive concept. FIGS. 6C and 6D are waveform diagrams illustrating signals provided to the pixel of FIG. 6B according to an exemplary embodiment of the inventive concept.

Referring to FIG. 6A, the liquid crystal display panel may include the plurality of pixels PX. Each of the pixels may include the red sub-pixel R, the green sub-pixel G, and the blue sub-pixel B. The gate line GL, a gate voltage control line GCL, and a switching line SL may be formed in the liquid crystal display panel. Each of the red sub-pixel R, the green sub-pixel G, and the blue sub-pixel B may be coupled to each of the gate line GL, the gate voltage control line GCL, and the switching line SL.

Referring to FIG. 6B, the red sub-pixel R may include a first control transistor TC1 coupled between the gate line GL and the gate voltage control line GCL, the green sub-pixel G may include a second control transistor TC2 coupled between the gate line GL and the gate voltage control line GCL, and the blue sub-pixel B may include a third control transistor coupled between the gate line GL and the gate voltage control line GCL. Here, a ratio of channel length to channel width of the first control transistor TC1, a ratio of channel length to channel width of the second control transistor TC2, and a ratio of channel length to channel width of the third control transistor TC3 may be different from one another. A gate electrode of the first control transistor TC1, a gate electrode of the second control transistor TC2, and a gate electrode of the third control transistor TC3 may be coupled to the switching line SL. The first control transistor TC1, the second control transistor TC2, and the third control transistor TC3 may turn on or turn off in response to a switching signal SS provided through the switching line SL.

The voltage generator may generate the gate on voltage Von and the gate off voltage Voff, and the gate driver may generate the gate signal GS based on the gate on voltage Von and the gate off voltage Voff. For example, a reference voltage Vref described in FIGS. 6C and 6D may have a ground level. The voltage level of the gate on voltage Von may be higher than the reference voltage Vref and the voltage level of the gate off voltage Voff may be lower than the reference voltage Vref. Further, the voltage generator may generate an off control voltage OCV having the voltage level lower than the gate off voltage Voff. The voltage generator may directly provide the off control voltage OCV to the gate voltage control line GCL in the liquid crystal display panel as an off control signal OCS. Alternatively, the voltage generator may provide the off control voltage OCV to the gate driver. The gate driver may generate the off control signal OCS based on the off control voltage OCV. Here, the off control voltage OCV and the off control signal OCS may be a constant voltage. The switching signal SS may be generated in the voltage generator or the timing controller.

Referring to FIG. 6C, the gate signal GS may be provided through the gate line GL, the switching signal SS may be provided through the switching line SL, and the off control signal OCS may be provided through the gate voltage control line GCL. The switching signal SS that turns on the first control transistor TC1, the second control transistor TC2, and the third control transistor TC3 may be provided when the gate signal GS has the gate off voltage Voff.

Referring again to FIG. 6B, when the gate signal GS having the gate off voltage Voff is provided through the gate line GL, the off control signal OCS having the voltage level lower than the gate off voltage Voff is provided through the gate voltage control line GCL, and the first control transistor TC1, the second control transistor TC2, and the third control transistor TC3 turn on, the current may flow through each of the first control transistor TC1, the second control transistor TC2, and the third control transistor TC3 in a direction from the gate line GL to the gate voltage control line GCL. Thus, the voltage level of the gate off voltage Voff provided through the gate line GL may be dropped.

Referring to FIG. 6D, the gate off voltage Voff of which the voltage level is dropped may be provided to the red sub-pixel R, the green sub-pixel G, and the blue sub-pixel B through the gate line GL. Here, the gate off voltage Voff of gate signal GS_R provided to the red sub-pixel R may be dropped by a first voltage drop amount Vd1, the gate off voltage Voff of gate signal GS_G provided to the green sub-pixel G may be dropped by a second voltage drop amount Vd2, and the gate off voltage Voff of gate signal GS_B provided to the blue sub-pixel B may be dropped by a third voltage drop amount Vd3 because the ratio of channel length to channel width of the first control transistor TC1, the ratio of channel length to channel width of the second control transistor TC2, and the ratio of channel length to channel width of the third control transistor TC3 are different from one another.

The liquid crystal display device according to an exemplary embodiment of the inventive concept may drop the gate off voltage Voff provided to each of the red sub-pixel R, the green sub-pixel G, and the blue sub-pixel B by different voltage amounts, so that the current leaked through the thin film transistor may be minimized although the driving properties of the thin film transistors of the red sub-pixel R, the green sub-pixel G, and the blue sub-pixel B are changed.

Figure 7A:
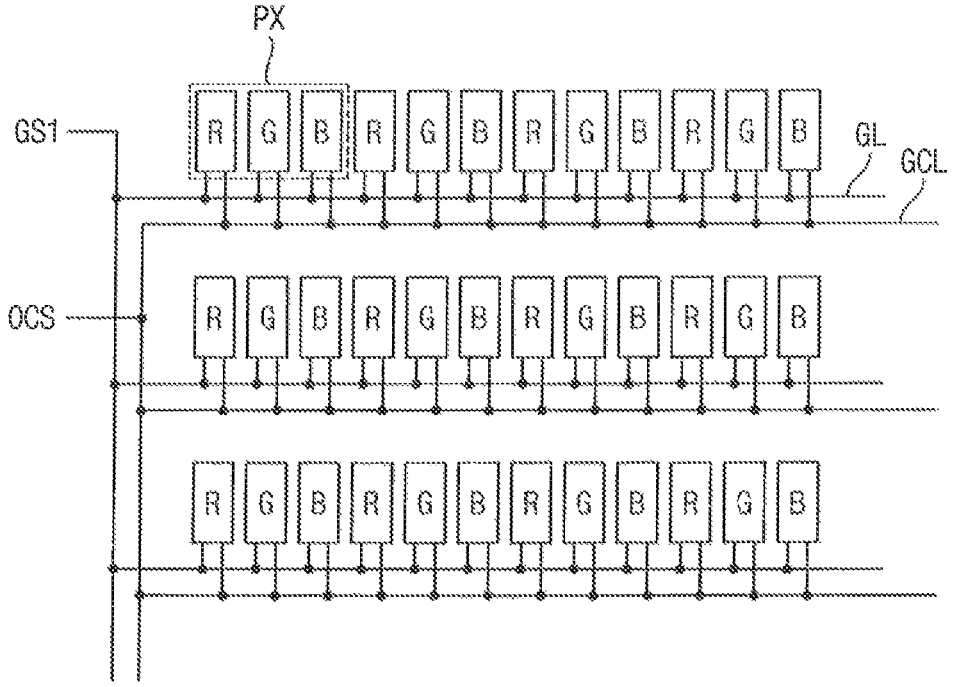
FIG. 7A is a diagram illustrating a liquid crystal display panel included in the liquid crystal display device of FIG. 1 according to an exemplary embodiment of the inventive concept.
Figure 7B:
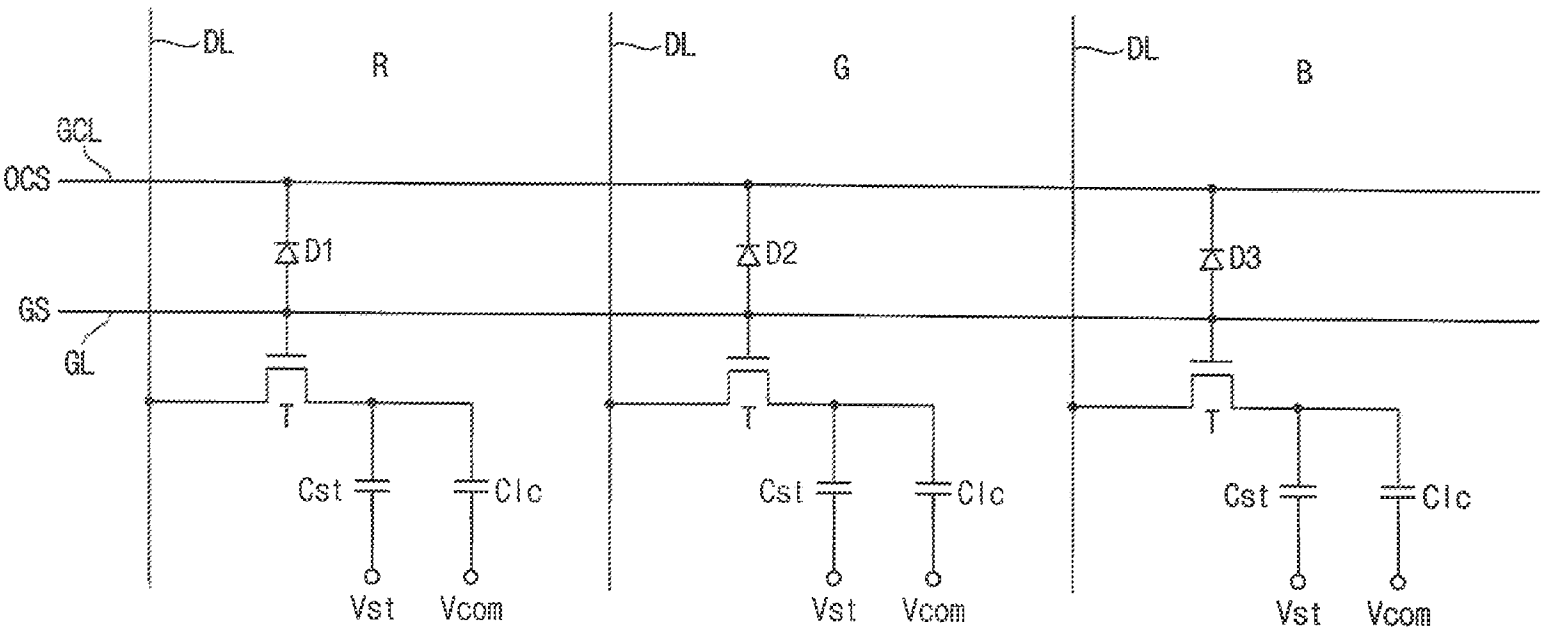
FIG. 7B is a diagram illustrating a pixel included in the liquid crystal display panel of FIG. 7A according to an exemplary embodiment of the inventive concept.
Figure 7C:
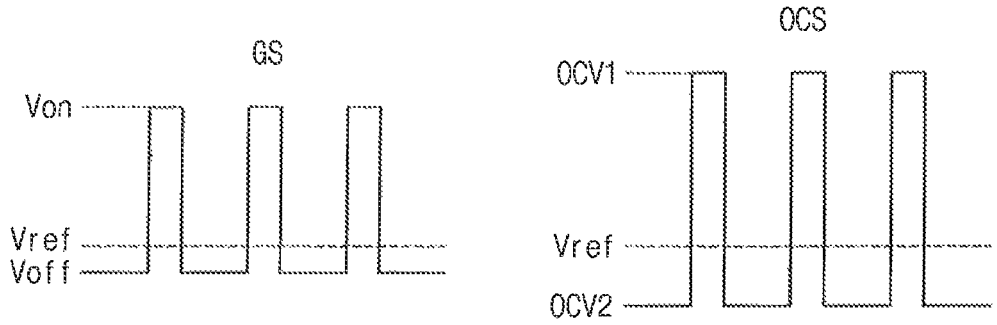
FIGS. 7C and 7D are waveform diagrams illustrating signals provided to the pixel of FIG. 7B according to an exemplary embodiment of the inventive concept.
Figure 7D:
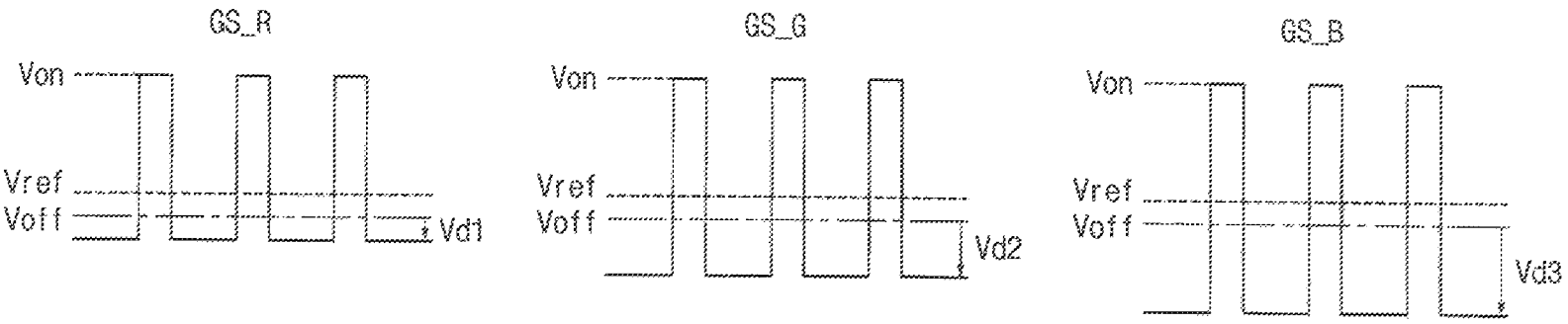

FIG. 7A is a diagram illustrating a liquid crystal display panel included in the liquid crystal display device of FIG. 1 according to an exemplary embodiment of the inventive concept. FIG. 7B is a diagram illustrating a pixel included in the liquid crystal display panel of FIG. 7A according to an exemplary embodiment of the inventive concept. FIGS. 7C and 7D are waveform diagrams illustrating signals provided to the pixel of FIG. 7B according to an exemplary embodiment of the inventive concept.

Referring to FIG. 7A, the liquid crystal display panel may include the plurality of pixels PX. Each of the pixels PX may include the red sub-pixel R, the green sub-pixel G, and the blue sub-pixel B. The gate line GL and the gate voltage control line GCL may be formed in the liquid crystal display panel. Each of the red sub-pixel R, the green sub-pixel G, and the blue sub-pixel B may be coupled to the gate line GL and the gate voltage control line GCL.

Referring to FIG. 7B, the red sub-pixel R may include a first diode D1 coupled between the gate line GL and the gate voltage control line GCL, the green sub-pixel G may include a second diode D2 coupled between the gate line GL and the gate voltage control line GCL, and the blue sub-pixel B may include a third diode D3 coupled between the gate line GL and the gate voltage control line GCL. Here, the voltage drop amount of the first diode D1, the voltage drop amount of the second diode D2, and the voltage drop amount of the third diode D3 may be different from one another.

The voltage generator may generate the gate on voltage Von and the gate off voltage Voff, and the gate driver may generate the gate signal GS based on the gate on voltage Von and the gate off voltage Voff. For example, a reference voltage Vref described in FIGS. 7C and 7D may have a ground level. The voltage level of the gate on voltage Von may be higher than the reference voltage Vref and the voltage level of the gate off voltage Voff may be lower than the reference voltage Vref. Further, the voltage generator may generate a first off control voltage OCV1 and a second off control voltage OCV2. The first off control voltage OCV1 may have a voltage level higher than the gate on voltage Von, and the second off control voltage OCV2 may have a voltage level lower than the gate off voltage Voff. The gate driver may generate the off control signal OCS that is a square waveform based on the first off control voltage OCV1 and the second off control voltage OCV2.

Referring to FIG. 7C, the off control signal OCS having the first off control voltage OCV1 may be provided when the gate signal GS having the gate on voltage Von is provided and the off control signal OCS having the second off control voltage OCV2 may be provided when the gate signal GS having the gate off voltage Voff is provided.

Referring again to FIG. 7B, the first diode D1, the second diode D2, and the third diode D3 may not be operated while the gate signal GS having the gate on voltage Von and the off control signal OCS having the first off control voltage OCV1 are provided. The first diode D1, the second diode D2, and the third diode D3 may be operated and the current may flow through the first diode D1, the second diode D2, and the third diode D3 while the gate signal GS having the off voltage Voff and the off control signal having the second off control voltage OCV2 are provided. Thus, the voltage level of the gate off voltage Voff provided through the gate line GL may be dropped.

Referring to FIG. 7D, the gate off voltages Voff of which the voltage levels are dropped may be provided to the red sub-pixel R, the green sub-pixel G, and the blue sub-pixel B. Here, current amounts flowing through each of the first diode D1, the second diode D2, and the third diode D3 may be different from one another. In other words, the gate off voltage Voff of the gate signal GS_R provided to the red sub-pixel R may be dropped by the first voltage drop amount Vd1, the gate off voltage of the gate signal GS_G provided to the green sub-pixel G may be dropped by the second voltage drop amount Vd2, and the gate off voltage of the gate signal GS_B provided to the blue sub-pixel B may be dropped by the third voltage drop amount Vd3 because the voltage drop amount of the first diode D1, the voltage drop amount of the second diode D2, and the voltage drop amount of the third diode D3 are different from one another.

The liquid crystal display device according to an exemplary embodiment of the inventive concept may provide the gate off voltages Voff, of which the voltage drop amounts are different from one another, to the red sub-pixel R, the green sub-pixel G, and the blue sub-pixel B, so that the current leaked through the thin film transistor may be prevented although the driving properties of the thin film transistors of the red sub-pixel R, the green sub-pixel G, and the blue sub-pixel B are changed.

Figure 8:
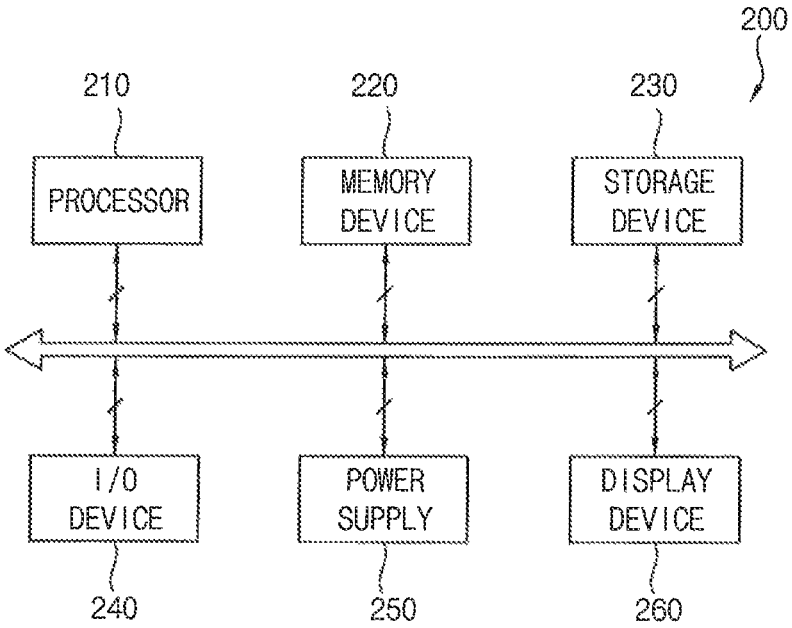
FIG. 8 is a block diagram illustrating an electronic device that includes the liquid crystal display device of FIG. 1 according to an exemplary embodiment of the inventive concept.
Figure 9:
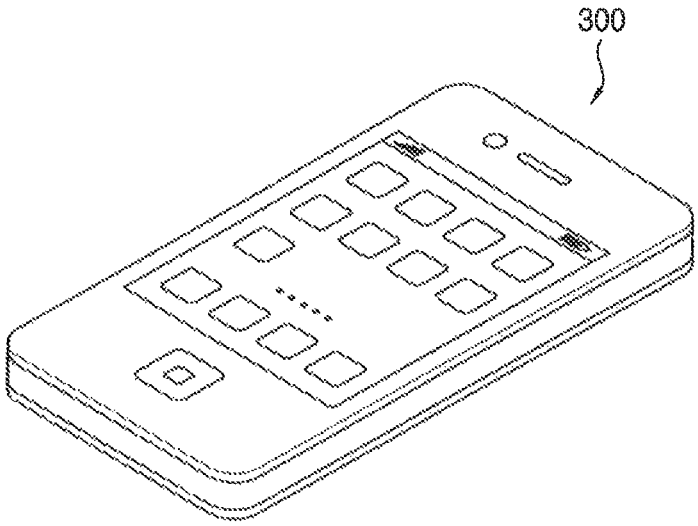
FIG. 9 is a diagram illustrating an exemplary embodiment of the inventive concept in which the electronic device of FIG. 8 is implemented as a smartphone.

FIG. 8 is a block diagram illustrating an electronic device that includes the liquid crystal display device of FIG. 1 according to an exemplary embodiment of the inventive concept, and FIG. 9 is a diagram illustrating an exemplary embodiment of the inventive concept in which the electronic device of FIG. 8 is implemented as a smartphone.

Referring to FIGS. 8 and 9, an electronic device 200 may include a processor 210, a memory device 220, a storage device 230, an input/output (I/O) device 240, a power device 250, and a display device 260. Here, the display device 260 may correspond to the liquid crystal display device 100 of FIG. 1. In addition, the electronic device 200 may further include a plurality of ports for communicating with a video card, a sound card, a memory card, a universal serial bus (USB) device, other electronic device, etc. Although it is illustrated in FIG. 9 that the electronic device 200 is implemented as a smartphone 300, the electronic device 200 is not limited thereto.

The processor 210 may perform various computing functions. The processor 210 may be a micro processor, a central processing unit (CPU), etc. The processor 210 may be coupled to other components via an address bus, a control bus, a data bus, etc. Further, the processor 210 may be coupled to an extended bus such as peripheral component interconnect (PCI) bus. The memory device 220 may store data for operations of the electronic device 200. For example, the memory device 220 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 230 may be a solid state drive (SSD) device, a hard disk drive (HDD) device, a CD-ROM device, etc.

The I/O device 240 may be an input device such as a keyboard, a keypad, a touchpad, a touch-screen, a mouse, etc, and an output device such as a printer, a speaker, etc. In exemplary embodiments of the inventive concept, the display device 260 may be included in the I/O device 240. The power device 250 may provide a power for operations of the electronic device 200. The display device 260 may communicate with other components via the buses or other communication links.

As described above, the display device 260 may include a liquid crystal display panel, a voltage generator, a timing controller, a gate driver, and a data driver. The liquid crystal display panel may include a plurality of pixels. Each of the pixels may include a plurality of sub-pixels. For example, each of the pixels may include a red sub-pixel, a green sub-pixel, and a blue sub-pixel.

In exemplary embodiments of the inventive concept, the liquid crystal display panel may include a first gate line coupled to the red sub-pixel, a second gate line coupled to the green sub-pixel, and a third gate line coupled to the blue sub-pixel. A first gate off voltage having a first voltage level may be provided through the first gate line, a second gate off voltage having a second voltage level may be provided through the second gate line, and a third gate off voltage having a third voltage level may be provided through the third gate line. The first voltage level, the second voltage level, and the third voltage level may be different from one another. Thus, the first gate off voltage, the second gate off voltage, and the third gate off voltage, of which the voltage levels are different, may be provided to the thin film transistors included in each of the red sub-pixel, the green sub-pixel, and the blue sub-pixel.

In exemplary embodiments of the inventive concept, the liquid crystal display panel may include the gate line, a gate voltage control line, and a switching line. The red sub-pixel may include a first control transistor coupled between the gate line and the gate voltage control line. The green sub-pixel may include a second control transistor coupled between the gate line and the gate voltage control line. The blue sub-pixel may include a third control transistor coupled between the gate line and the gate voltage control line. Ratios of channel length to channel width (W/l) of the first control transistor, the second control transistor, and the third control transistor may be different from one another. An off control signal may be provided through the gate voltage control line. The off control signal may be a constant voltage signal having a voltage level lower than the gate off voltage. When the first control transistor, the second control transistor, and the third control transistor turn on in response to the switching signal, current may flow from the gate line to gate voltage control line. Thus, the voltage level of the gate off voltage provided through the gate line may be dropped. Here, the voltage drop amounts of the gate off voltage of the red sub-pixel, the green sub-pixel, and the blue sub-pixel may be different because the ratio of channel length to channel width of the first control transistor, the ratio of channel length to channel width of the second control transistor, and the ratio of channel length to channel width of the third control transistor are different from one another. Thus, the gate off voltage provided to the thin film transistor of the red sub-pixel, the gate off voltage provided to the thin film transistor of the green sub-pixel, and the gate off voltage provided to the thin film transistor of the blue sub-pixel may be dropped to have different voltage levels.

In exemplary embodiments of the inventive concept, the liquid crystal display panel may further include a gate voltage control line coupled to the pixels. The red sub-pixel may include a first diode coupled between the gate line and the gate voltage control line, the green sub-pixel may include a second diode coupled between the gate line and the gate voltage control line, and the blue sub-pixel may include a third diode coupled between the gate line and the gate voltage control line. The voltage drop amounts of the first diode, the second diode, and the third diode may be different from one another. An off control signal may be provided through the gate voltage control line. The off control signal may be a square waveform signal that includes a first off control voltage having a voltage level higher than the gate on voltage and a second off control voltage having a voltage level lower than the gate off voltage. The off control signal having the first off control voltage may be provided when the gate on voltage is provided through the gate line and the off control signal having the second off control voltage may be provided when the gate off voltage is provided through the gate line. When the gate off voltage is provided through the gate voltage control line, the off control signal having the second off control voltage is provided through the gate voltage control line, so that the first diode, the second diode, and the third diode may turn on and a current of the gate line may flow to the gate voltage control line. Here, the voltage drop amount of the gate off voltage provided to the thin film transistor of the red sub-pixel, the voltage drop amount of the gate off voltage provided to the thin film transistor of the green sub-pixel, and the voltage drop amount of the gate off voltage provided to the thin film transistor of the blue sub-pixel may be different because the voltage drop amounts of the first diode, the second diode, and the third diode are different.

As described above, the electronic device 200 of FIG. 8 may include the display device 260 that minimizes the leakage currents of the thin film transistors included in each of the red sub-pixel, the green sub-pixel, and the blue sub-pixel by providing the gate off voltages of the gate signal having different voltage levels to the red sub-pixel, the green sub-pixel, and the blue sub-pixel. Thus, the display quality of the display device 260 may improve.

The inventive concept may be applied to a display device and an electronic device having the display device. For example, the inventive concept may be applied to a computer monitor, a laptop, a digital camera, a cellular phone, a smartphone, a smart pad, a television, a personal digital assistant (PDA), a portable multimedia player (PMP), a MP3 player, a navigation system, a game console, a video phone, etc.

As described above, according to exemplary embodiments of the inventive concept, the liquid crystal display device and the electronic device having the same may minimize currents leaked through the thin film transistor of the red sub-pixel, the thin film transistor of the green sub-pixel, and the thin film transistor of the blue sub-pixel by providing the gate off voltages having different voltage levels to the pixels according to the driving properties of the thin film transistors included in the red sub-pixel, the green sub-pixel, and the blue sub-pixel. Thus, display quality may improve.

While the inventive concept has been particularly shown and described with reference to exemplary embodiments thereof, it will be understood by those of ordinary skill in the art that various changes in form and details may be made thereto without departing from the spirit and scope of the inventive concept as set forth by the following claims.

What is claimed is:

1. A liquid crystal display device comprising:

a liquid crystal display panel including a plurality of pixels;

a voltage generator configured to generate a gate on voltage and a gate off voltage;

a gate driver configured to generate a gate signal using the gate on voltage and the gate off voltage, and provide the gate signal to the plurality of pixels;

a data driver configured to provide a data signal to the plurality of pixels; and a timing controller configured to generate control signals that control the gate driver and the data driver, wherein each of the plurality of pixels includes a red sub-pixel, a green sub-pixel, and a blue sub-pixel, wherein a voltage level of the gate off voltage provided to the red sub-pixel, a voltage level of the gate off voltage provided to the green sub-pixel, and a voltage level of the gate off voltage provided to the blue sub-pixel are different from one another, wherein the liquid crystal display panel includes gate lines and gate voltage control lines coupled to the plurality of pixels, wherein the voltage generator generates a first off control voltage having a voltage level higher than a voltage level of the gate on voltage and a second off control voltage having a voltage level lower than a voltage level of the gate off voltage, and wherein the gate driver generates an off control signal using the first off control voltage and the second off control voltage, and provides the off control signal to the plurality of pixels through the gate voltage control lines.

2. The liquid crystal display device of claim 1, wherein the liquid crystal display panel includes a first gate line coupled to the red sub-pixel, a second gate line coupled to the green sub-pixel, and a third gate line coupled to the blue sub-pixel.

3. The liquid crystal display device of claim 2, wherein the voltage generator generates a first gate off voltage having a first voltage level, a second gate off voltage having a second voltage level, and a third gate off voltage having a third voltage level.

4. The liquid crystal display device of claim 3, wherein the gate driver generates a first gate signal provided to the red sub-pixel through the first gate line using the gate on voltage and the first gate off voltage, a second gate signal provided to the green sub-pixel through the second gate line using the gate on voltage and the second gate off voltage, and a third gate signal provided to the blue sub-pixel through the third gate line using the gate on voltage and the third gate off voltage.

5. The liquid crystal display device of claim 1, wherein the red sub-pixel includes a first diode coupled between a corresponding one of the gate lines and a corresponding one of the gate voltage control lines, wherein the first diode drops a voltage level of the gate off voltage, wherein the green sub-pixel includes a second diode coupled between the corresponding one of the gate lines and the corresponding one of the gate voltage control lines, wherein the second diode drops a voltage level of the gate off voltage, and wherein the blue sub-pixel includes a third diode coupled between the corresponding one of the gate lines and the corresponding one of the gate voltage control lines, wherein the third diode drops a voltage level of the gate off voltage.

6. The liquid crystal display device of claim 5, wherein each of a voltage drop amount of the first diode, a voltage drop amount of the second diode, and a voltage drop amount of the third diode are different from one another.

7. A liquid crystal display device comprising:

a liquid crystal display panel including a plurality of pixels;

a voltage generator configured to generate a gate on voltage and a gate off voltage;

a gate driver configured to generate a gate signal using the gate on voltage and the gate off voltage, and provide the gate signal to the plurality of pixels;

a data driver configured to provide a data signal to the plurality of pixels; and a timing controller configured to generate control signals that control the gate driver and the data driver, wherein each of the plurality of pixels includes a red sub-pixel, a green sub-pixel, and a blue sub-pixel, wherein a voltage level of the gate off voltage provided to the red sub-pixel, a voltage level of the gate off voltage provided to the green sub-pixel and a voltage level of the gate off voltage provided to the blue sub-pixel are different from one another, wherein the liquid crystal display panel includes gate lines, gate voltage control lines, and switching lines coupled to the plurality of pixels, wherein the voltage generator generates an off control voltage having a voltage level lower than the gate off voltage, and wherein the gate driver generates an off control signal using the off control voltage and provides the off control signal to the plurality of pixels through the gate voltage control lines.

8. The liquid crystal display device of claim 7, wherein the red sub-pixel includes a first control transistor coupled between a corresponding one of the gate lines and a corresponding one of the gate voltage control lines, wherein the green sub-pixel includes a second control transistor coupled between the corresponding one of the gate lines and the corresponding one of the gate voltage control lines, and wherein the blue sub-pixel includes a third control transistor coupled between the corresponding one of the gate lines and the corresponding one of the gate voltage control lines.

9. The liquid crystal display device of claim 8, wherein each of ratios of channel length to channel width (W/L) of the first control transistor, the second control transistor, and the third control transistor are different from one another.

10. The liquid crystal display device of claim 8, wherein a corresponding one of the switching lines is coupled to a gate electrode of the first control transistor, a gate electrode of the second control transistor, and a gate electrode of the third control transistor, and provides a switching signal to the gate electrode of the first control transistor, the gate electrode of the second control transistor, and the gate electrode of the third control transistor.

11. The liquid crystal display device of claim 10, wherein the switching signal is a square wave signal that turns on the first control transistor, the second control transistor, and the third control transistor when the gate signal having the gate off voltage is provided through the corresponding one of the gate lines.

12. An electronic device includes a display device and a processor configured to control the display device, wherein the display device comprising:

a liquid crystal display panel including a plurality of pixels;

a voltage generator configured to generate a gate on voltage and a gate off voltage;

a gate driver configured to generate a gate signal using the gate on voltage and the gate off voltage and provide the gate signal to the plurality of pixels;

a data driver configured to provide a data signal to the plurality of pixels; and a timing controller configured to generate control signals that control the gate driver and the data driver, wherein each of the plurality of pixels includes a red sub-pixel, a green sub-pixel, and a blue sub-pixel, wherein a voltage level of the gate off voltage provided to the red sub-pixel, a voltage level of the gate off voltage provided to the green sub-pixel, and a voltage level of the gate off voltage provided to the blue sub-pixel are different from one another, wherein the liquid crystal display panel includes gate lines and gate voltage control lines coupled to the plurality of pixels, wherein the red sub-pixel includes a first control transistor coupled between a corresponding one of the gate lines and a corresponding one of the gate voltage control lines, wherein the green sub-pixel includes a second control transistor coupled between the corresponding one of the gate lines and the corresponding one of the gate voltage control lines, wherein the blue sub-pixel includes a third control transistor coupled between the corresponding one of the gate lines and the corresponding one of the gate voltage control lines, wherein each of ratios of channel length to channel width (W/L) of the first control transistor, the second control transistor, and the third control transistor are different from one another, and wherein an off control signal provided through the gate voltage control line is a static voltage signal having a voltage level lower than the gate off voltage.

13. The electronic device of claim 12, wherein the liquid crystal display panel includes a first gate line coupled to the red sub-pixel, a second gate line coupled to the green sub-pixel, and a third gate line coupled to the blue sub-pixel, wherein the voltage generator generates a first gate off voltage having a first voltage level, a second gate off voltage having a second voltage level, and a third gate off voltage having a third voltage level, and wherein the gate driver generates a first gate signal provided to the red sub-pixel through the first gate line using the gate on voltage and the first gate off voltage, a second gate signal provided to the green sub-pixel through the second gate line using the gate on voltage and the second gate off voltage, and a third gate signal provided to the blue sub-pixel through the third gate line using the gate on voltage and the third gate off voltage.

14. The electronic device of claim 12, wherein the liquid crystal display panel further includes:

a plurality of switching lines coupled to the plurality of pixels, and wherein a corresponding one of the plurality of switching lines are coupled to a gate electrode of the first control transistor, a gate electrode of the second control transistor, and a gate electrode of the third control transistor, and wherein a switching signal is provided through the plurality of switching lines.

15. The electronic device of claim 12, wherein the red sub-pixel includes a first diode coupled between a corresponding one of the gate lines and a corresponding one of the gate voltage control lines, wherein the first diode drops a voltage level of the gate off voltage, wherein the green sub-pixel includes a second diode coupled between the corresponding one of the gate lines and the corresponding one of the gate voltage control lines, wherein the second diode drops a voltage level of the gate off voltage, wherein the blue sub-pixel includes a third diode coupled between the corresponding one of the gate lines and the corresponding one of the gate voltage control lines, wherein the third diode drops a voltage level of the gate off voltage, wherein each of an amount of voltage drop of the first diode, an amount of voltage drop of the second diode, and an amount of voltage drop of the third diode are different from one another, and wherein a gate off signal provided through the corresponding one of the gate lines is a square signal that has a voltage level higher than a voltage level of the gate on voltage and lower than the voltage level of the gate off voltage.

* * * * *